United States Patent [19]

Willis et al.

[11] 4,084,274

[45] Apr. 18, 1978

[54] TURNING BED

[75] Inventors: David John Willis, Lower Hutt; Dennis Clifford Stevenson; William Bettle, both of Christchurch, all of New Zealand

[73] Assignee: Betstone Industries Limited, Christchurch, New Zealand

[21] Appl. No.: 678,769

[22] Filed: Apr. 21, 1976

[30] Foreign Application Priority Data

May 1, 1976 New Zealand ..... 117001

[51] Int. Cl.[2] ..... A61G 7/10

[52] U.S. Cl. ..... 5/61; 5/86; 5/66

[58] Field of Search ..... 5/60–62, 5/66, 86

[56] References Cited

U.S. PATENT DOCUMENTS

| | | | |
|---|---|---|---|
| 1,740,906 | 12/1929 | Rothauszky | 5/61 |
| 2,522,018 | 9/1950 | Blackman | 5/61 |
| 2,700,583 | 1/1955 | Davis et al. | 5/66 |
| 3,210,778 | 10/1965 | Robinson | 5/61 |
| 3,238,539 | 3/1966 | Koch | 5/61 |
| 3,748,666 | 7/1973 | Seng et al. | 5/61 |
| 3,875,598 | 4/1975 | Foster et al. | 5/61 |

*Primary Examiner*—Casmir A. Nunberg
*Attorney, Agent, or Firm*—Hauke & Patalidis

[57] ABSTRACT

A turning bed which can be tilted mechanically to turn the occupant from side to side, comprising a tilting assembly pivotally secured to a bed frame of known type. The tilting assembly consists of a mattress frame longitudinally divided into at least three parts: a center section with an outer section(s) pivotally connected adjacent each longitudinal side of the center section. The pivotal connection is such that when the center section is tilted, the outer section(s) adjacent the raised side of the center section is/are tilted as one with the center section, and the outer section(s) adjacent the other side of the center section pivot(s) relative thereto. The center section is pivotally supportable from the bed frame, and can be tilted by a lever secured at one end to the center section, the other end of the lever being moveable (by suitable means such as a screw-and-nut arrangement) to tilt the center section.

18 Claims, 7 Drawing Figures

TURNING BED

BACKGROUND OF THE INVENTION

The present invention relates to a turning bed i.e. a bed which can be tilted mechanically to turn the occupant from side to side. Turning beds are especially useful for persons who by reason of disability or age are unable by themselves to turn or move in bed, and so run the risk of contracting conditions such as bed sores, hypostatic pneumonia, or blood clotting. Moving such persons manually at frequent intervals is time-consuming and physically tiring for a nurse, and hence turning beds have been developed which mechanically turn the occupant, the turning being either carried out automatically at pre-selected time-intervals or controlled by a nurse.

A number of turning beds are already known in which the mattress of the bed, and a frame supporting the mattress, are divided into several parts, the parts being moveable relative to one another to turn the occupant of the bed. For example, U.S. Pat. No. 1,740,906 discloses a multi-part mattress and frame; and U.S. Pat. No. 2,522,018 discloses a mattress and frame longitudinally divided into three parts, the central section of which can be tilted by a longitudinally-extending drive-shaft, the three frame sections being so linked that one or other of the side frame sections is tilted with said central section.

BRIEF SUMMARY OF THE INVENTION

An object of the present invention is the provision of a tilting assembly which may be fitted to a bed frame of known type, to form a turning bed. As used herein, the term 'bed frame' means a rectangular frame supported by legs or other suitable support means.

A further object of the present invention is the provision of a turning bed of the type having a divided mattress frame, which is particularly simple and inexpensive in construction.

In accordance with the present invention there is provided a tilting assembly for a bed, comprising:

a longitudinally divided mattress frame including a centre section which is pivotally supportable from the frame of a bed, and an outer section adjacent each longitudinal side of said centre section, each said outer section being pivotally connected to the centre section such that tilting the centre section to raise one longitudinal side thereof causes the outer section adjacent said raised longitudinal side to be tilted as one with the centre section, and the outer section adjacent the other longitudinal side of the centre section to pivot relative to the centre section;

a lever secured at one end to the centre section, the other end of said lever being moveable so as to tilt the centre section;

and means for moving said lever.

Preferably, the pivotal connection between the centre section and each said outer section is such that tilting the centre section to raise one longitudinal side thereof causes tilting of the outer section adjacent said other longitudinal side of the centre section, the longitudinal side furthest from the centre section of said outer section being raised.

Preferably also, the pivotal connection between the centre section and each outer section comprises: a plate secured across each end of each said section, the plane of each said plate being substantially perpendicular to the plane of said section; adjacent plates being arranged to butt against each other when the centre section is not tilted; and a bracket extending across said adjacent plates, said bracket being pivotally secured to one of said plates and rigidly secured to the other of said plates.

By way of example only, preferred embodiments of the present invention are described in detail with reference to the accompany drawings.

DETAILED DESCRIPTION OF THE INVENTION

Figure 1:
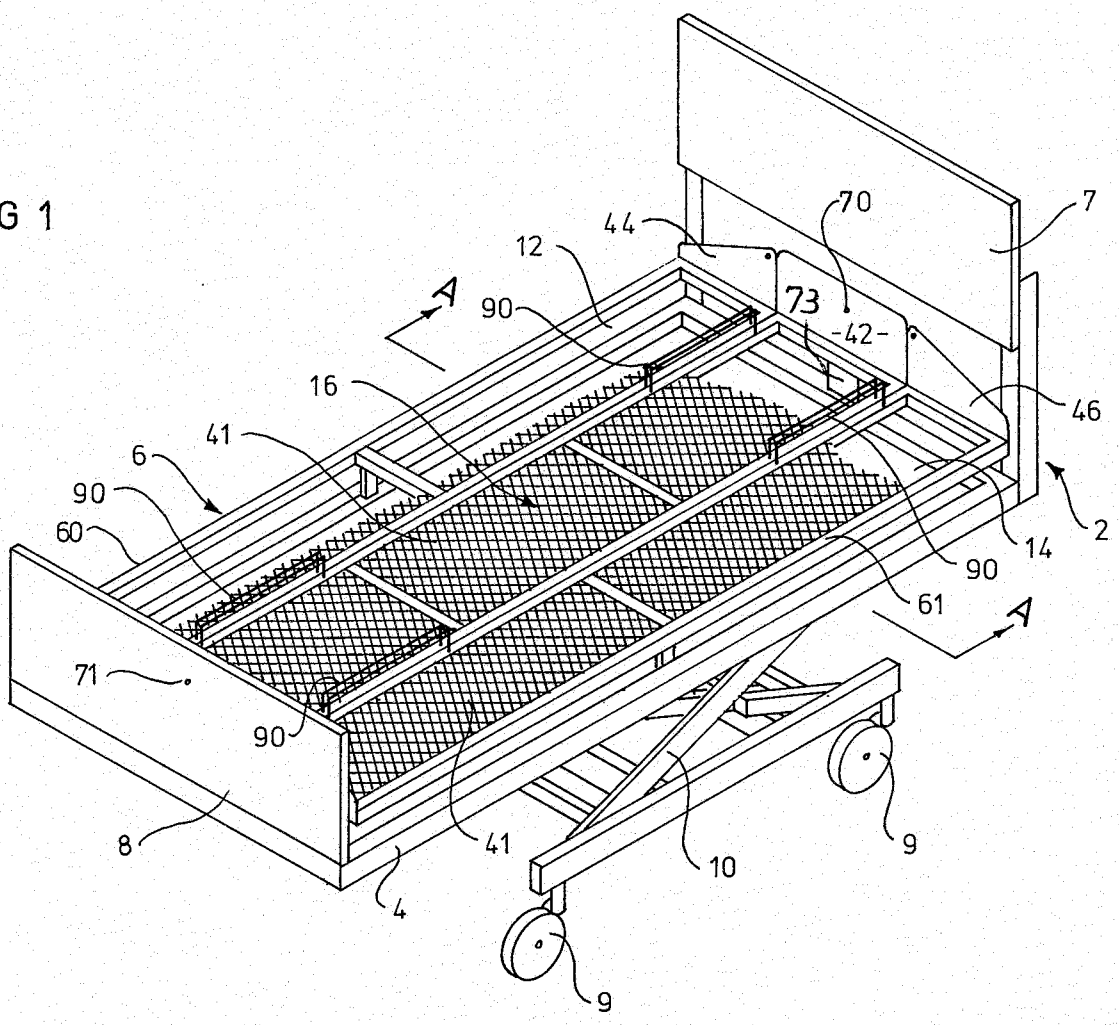
FIG. 1 is an isometric view of a bed comprising a tilting assembly in the horizontal position secured to a bed frame.
Figure 2:
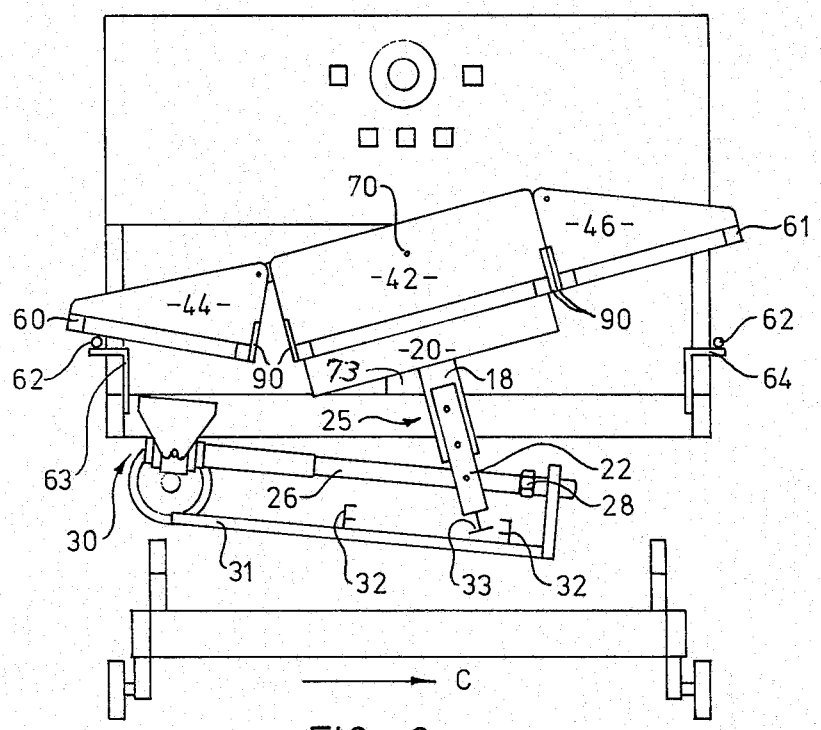
FIG. 2. is a section on line A—A of FIG. 1.
Figure 3:
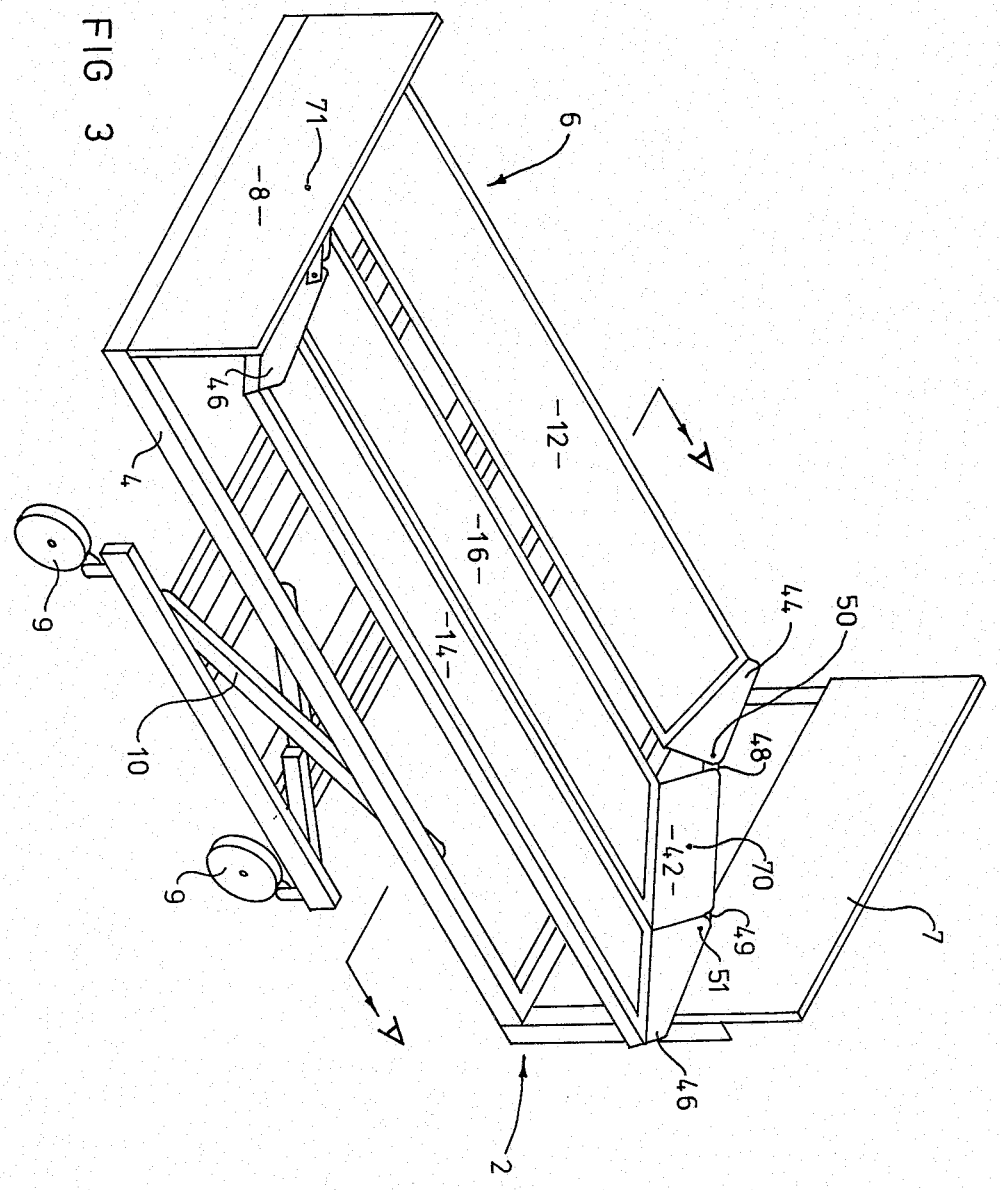
FIG. 3. is an isometric view of the bed of FIG. 1. with said assembly in a tilted position.

Referring to FIGS. 1 – 3 of the drawings, a hospital bed 2 in accordance with a first embodiment of the present invention comprises a conventional metal bed frame 4 which supports a tilting assembly including a moveable mattress frame 6. The bed frame 4 is provided with a headboard 7 and a footboard 8, and is mounted on castors 9. The height of the bed-frame 4 is adjustable by altering the angle of the diagonal supports 10 in known manner.

Figure 6:
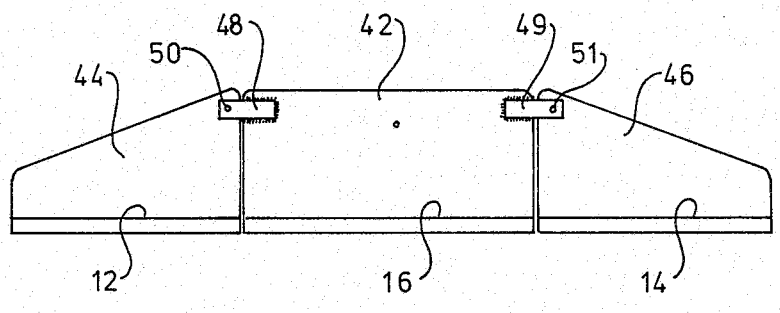
FIG. 6. is a side view of a detail of FIGS. 1–3 & 5.

The mattress frame 6 is divided longitudinally into three sections: two outer sections 12, 14, and a centre section 16. Each section of the mattress frame 6 comprises a rectangular metal frame 40 over which expanded metal mesh 41 (omitted in FIG. 3) is secured to provide a mattress-supporting surface. The sections are not connected together along their longitudinal sides, but are connected across their widths by a series of plates (FIG. 6): the centre section 16 has a rectangular plate 42 rigidly secured across each end, and each of the outer sections 12, 14, has a triangular plate 44, 46, rigidly secured across each end, such that one edge of each said plate 44, 46 abuts the adjacent edge of the plate 42. The plane of each said plate is perpendicular to the plane of the mesh 41. Brackets 48, 49 are welded to the rectangular plate 42 near each of said adjacent edges, such that the bracket overlaps the adjacent plate 44 or 46. Pivot pins 50, 51 extend through corresponding holes in the bracket 48 and the plate 44, and the bracket 49, and the plate 46, respectively. Thus, when the centre section is tilted as shown in FIGS. 2 & 3 (described hereinafter) one of the outer sections 14 is raised with the upwardly tilted side of the centre section, the plate 46 abutting against the adjacent side of the plate 42, the other outer section 12 is tilted with its longitudinal side nearest the centre section inclined downwards towards the centre section, due to friction between the plate 44 and the adjacent side of the plate 46. The pivot pins 50, 51 permit the centre section to pivot relative to the outer section 12.

When the centre section is tilted in the opposite direction to that shown in FIG. 2, the other outer section 12 is raised with the centre section, the first outer section 14 being tilted with its longitudinal side nearest the centre section inclined downwards towards the centre section. The centre section 16 is supported from the mattress frame 6 by a pair of pivot pins 70, 71, one said pin extending through an aperture in each of the rectangular plates 42, at approximately the mid-point of the width of said plate. One pivot pin 70 pivotally secures the plate 42 at the head of the bed to an upright 73 which extends vertically upwards from the mid-point of the width of the bed frame 4. The other pivot pin 71 pivotally secures the plate 42 at the foot of the bed to the mid-point of the width of the footboard 8. Thus, the centre section 16 can pivot freely relative to the bed frame, and the outer sections 12, 14, are supported from the centre section by the plates 44, 46, as described above. When the centre and outer sections are horizontal, as shown in FIG. 1 the outer sections are also supported along their outer longitudinal sides 60, 61 by bearings 62 carried on flanges 63, 64 which are secured along each longitudinal edge of the bed frame 4.

Figure 4:
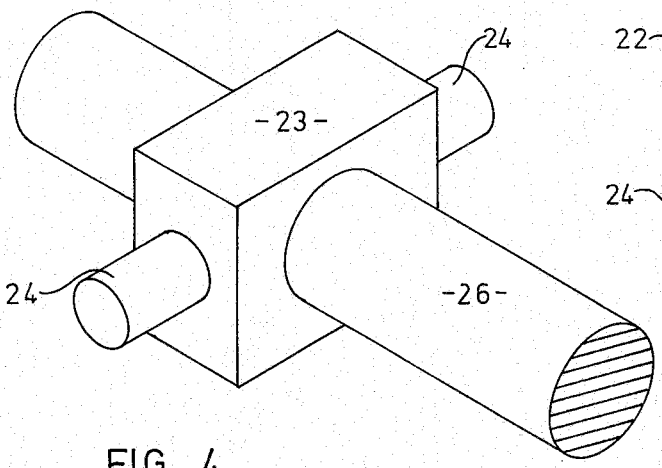
FIG. 4 is an isometric view of a detail of FIG. 2 on an enlarged scale.
Figure 4A:
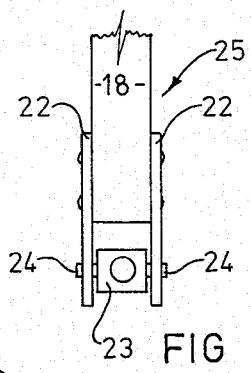
FIG. 4*a*. is a side view of a detail of FIG. 2. on an enlarged scale.

The mechanism for tilting the centre section 16 of the mattress frame is as follows: a cross-piece 20 is rigidly secured across the width of the centre section 16 at a position nearer the head than the foot of the bed. To the centre of this cross-piece 20 is rigidly secured a downwardly extending arm 18, to each side of which are bolted parallel plates 22, which extend below the end of said arm 18. Said arm 18 and said plates 22 together form a lever 25. A nut 23 (FIG. 4) is pivotally mounted between the plates 22 by means of bearings 24. The nut 23 is internally screw-threaded with a thread matching that formed externally on a screw 26. The screw 26 is pivotally mounted at one end for rotation by a reversible electric motor 30 through a worm and worm-wheel drive (not shown) which is arranged to produce slow rotation of the screw 26 when the motor 30 is operated. Rotation of the screw 26 in one sense causes travel of the nut 23 along the screw in the direction indicated by arrow C; rotation of the screw 26 in the opposite sense causes the nut 23 to travel in the opposite direction. The pivotal mounting of the nut 23 ensures that the plane of the nut is always perpendicular to the length of the screw and the screw-thread on said nut is always correctly engaged with the screw-thread on the screw as the nut moves along the screw. The free end of the screw 26 is fitted with a stop 28 to prevent the nut 23 travelling beyond the end of the screw 26. Movement of the nut 23 in either of said directions causes corresponding movement of the end of the lever 25 to which the nut is secured, and so tilts the centre section 16 which pivots on the pivot pins 70, 71.

A bar 31, parallel to the screw 26, is carried by the motor mounting and supports two spaced proximity switches 32 of known type. The lower end of one of the plates 22 carries a T-shaped metal plate 33; when part of the head of the 'T' is inserted between the jaws of one of said switches 32, the switch is closed. Each proximity switch is connected to the motor 30 such that closing said switch either stops or reverses the motor, and the positions of said switches on the bar 31 can be varied by sliding said switches along the bar 31.

In use, the mattress frame is covered by an interior spring or rubber mattress which is divided into sections corresponding to the mattress frame sections through at least part of its thickness, so that it can bend when the frame sections are tilted.

The mattress is held in place by locating members 90 which are secured to adjacent longitudinal sides of the centre and outer mattress frames. The mattress is formed with slots or pockets to accommodate these members. The members prevent the mattress slipping on the mattress frame when part of said frame is tilted.

The occupant of the bed normally lies on the centre section of the mattress-covered mattress frame. To turn the occupant e.g. onto his right side, ('left' and 'right' being given from the occupant's point of view), the motor 30 is started and slowly rotates the screw 26 so that the nut 23 moves in the direction of arrow C (FIG. 2). This movement of the nut 23 moves the free end of the lever 25, and tilts the centre section 16 of the mattress frame so that the left-hand outer section rises, rolling the occupant onto his right side. Simultaneously, the part of the right-hand outer section nearest the centre section sinks slightly, while the outermost part of said section rises slightly, preventing the occupant from rolling too far and giving the occupant a feeling of security. The centre section continues to tilt until the head of the 'T' shaped plate 33 closes the corresponding proximity switch 32, and either stops or reverses the motor 30. To turn the occupant onto his left side, the centre section is tilted the opposite way. The tilting may be controlled manually, the worm and worm-wheel drive being rotated directly by a crank (not shown). Alternatively, the worm and worm-wheel drive is rotated by the electric motor 30 as described above. The electric motor may be controlled by a nurse or by the occupant of the bed, who operates an off/on switch for the desired direction and degree of tilt. In many cases, the occupant must be turned from one side to the other at frequent regular intervals, and the electric motor 30 therefore is connected to a timing mechanism, which switches the electric motor 30 to tilt the mattress frame first in one direction and then after a time-interval, in the other direction. During said time-interval, the mattress-frame remains tilted. Preferably, an electronic timing mechanism of known type is used.

The angle to which the central section of the mattress frame is tilted by the motor 30 is governed by the location of the proximity switches 32 on the bar 31: the nearer a switch is to the head of the 'T' shaped plate 33 when the central section is horizontal the smaller the angle of a tilt of the central section before the 'T' shaped plate 33 closes said switch and stops the motor 30. Conversely, the near a switch is to the head of the T-shaped plate 33 when the central section is horizontal, the larger the angle of tilt of the central section before said switch is closed.

Figure 5:
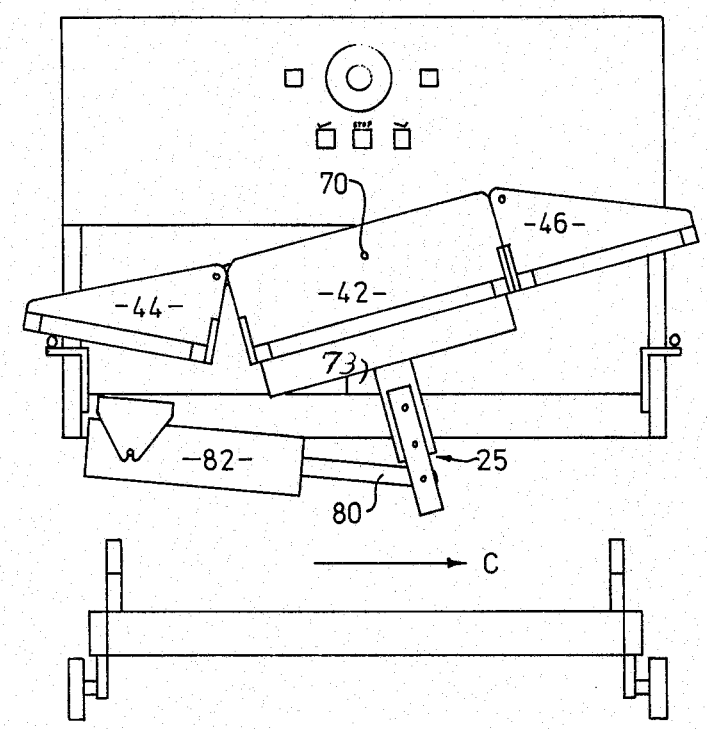
FIG. 5. is a side view of an alternative drive arrangement.

It will be appreciated that the above-described design could be varied to suit particular use. For example, if the bed were to be used for a very heavy occupant, the centre mattress section could be tilted by two motor-and-shaft drives, one adjacent each end of said section, instead of a single drive as described above. Further, the screw-and-nut drive acting on the lever 25 may be replaced by a double-acting hydraulic or pneumatic piston-and-cylinder as shown in FIG. 5. The lower end of the lever 25 is pivotally secured to one end of a piston rod 80, the other end of which is attached to a double-acting piston in a cylinder 82. Hydraulic fluid or air can be admitted to either side of the cylinder to move the piston rod 80, and hence the end of the lever 25, in the direction of arrow C or the opposite direction. Hydraulic fluid or air is supplied to the cylinder 82 by a motor-driven pump or by a foot-pump (not shown). The motor-driven pump 83 may be controlled by the nurse or occupant of the bed, or may be connected to an electronic timing device to operate automatically at pre-set intervals.

Preferably, the mattress frame is divided longitudinally into 3 sections, as described above. However, if desired the centre section of said frame may have two or more outer sections pivotally secured adjacent each longitudinal side thereof. Each said outer section is pivotally secured to the or each adjacent outer section, in the same manner as the centre section is secured to said outer sections. When the centre section is tilted, the outer sections adjacent the upwardly tilted side thereof are raised as one with said centre section, and the outer sections adjacent the other side of the centre section tilt downwards towards said side by different degrees depending upon the amount of friction in the pivotal connection between said outer sections.

The tilting assembly described in the foregoing can be fitted to most conventional hospital types of bed frame. The tilting assembly comprising the mattress frame, lever, and tilting mechanism may be made and sold separately from the bed frame, and fitted to conventional hospital beds, thus greatly reducing the cost to the hospital.

What we claim is:

1. A tilting assembly for a bed comprising:

a longitudinally divided mattress frame including a centre section which is pivotally supportable from the frame of a bed, and an outer section adjacent each longitudinal side of said centre section, each said outer section being pivotally connected to the centre section;

wherein the pivotal connection between the centre section and each outer section comprises a plate secured across each end of each said section, the plane of each said plate being substantially perpendicular to the plane of said section, adjacent plates being arranged to butt against each other when the centre section is not titled, and a bracket extending across said adjacent plates, said bracket being pivotally secured to one of said plates and rigidly secured to the other of said plates, such that tilting the centre section to raise one longitudinal side thereof causes tilting of the outer section adjacent said longitudinal side of the centre section, the longitudinal side furthest from the centre section of said outer section being raised;

a lever secured at one end to the centre section, the other end of said lever being moveable so as to tilt the center section;

and means for moving said lever.

2. A tilting assembly as claimed in claim 1 wherein the mattress frame comprises three sections only.

3. A tilting assembly as claimed in claim 1 wherein the means for moving the lever comprises, a nut pivotally secured to said other end of the lever, the nut being engageable with a screw such that rotation of the screw causes travel of the screw therealong.

4. A tilting assembly as claimed in claim 3 wherein said screw is rotatable in either sense by a worm and worm-wheel mechanism.

5. A tilting assembly as claimed in claim 4 wherein said worm and worm-wheel mechanism is manually drivable.

6. A tilting assembly as claimed in claim 4 wherein said worm and worm-wheel mechanism is drivable by a reversible electric motor.

7. A tilting assembly as claimed in claim 6 further comprising a reversible electric motor.

8. A tilting assembly as claimed in claim 1 wherein the means for moving the lever comprises a piston rod connected to said other end of the lever, the piston rod being reciprocable in a plane substantially perpendicular to the lever by means of a double-acting piston.

9. A tilting assembly as claimed in claim 8 wherein said piston is operable by pneumatic pressure.

10. A tilting assembly as claimed in claim 8 wherein said piston is operable by hydraulic pressure.

11. A tilting assembly as claimed in claim 1 further comprising an electronic timing mechanism arranged to operate said lever-moving means at preselected time intervals.

12. A tilting assembly as claimed in claim 13, further comprising a mattress longitudinally jointed to form three sections corresponding in dimensions to said centre section and outer sections of the mattress frame, said locating members being arranged to abut against the longitudinal sides of the centre mattress section.

13. A tilting assembly as claimed in claim 1, further comprising locating members secured at intervals along each longitudinal side of the centre section, said locating members being arranged to cooperate with a mattress or mattress section to prevent slip between the centre section and said mattress or mattress section.

14. A tilting assembly as claimed in claim 1 further comprising a bed frame, the centre section of the mattress frame being pivotally supported by said bed frame.

15. A tilting assembly as claimed in claim 14 wherein each said longitudinal side of said bed frame is provided with a bearing surface for supporting the outermost longitudinal sides of said mattress frame when the centre section is not tilted.

16. A tilting assembly as claimed in claim 14 wherein the centre section of said turning bed is pivotally secured at one end to a footboard secured to one end of said bed frame, and at the other end to an upright secured to and extending upwardly from the other end of said bed frame.

17. A tilting assembly as claimed in claim 6 further comprising an electronic timing mechanism arranged to operate said lever-moving means at preselected time intervals.

18. A tilting assembly as claimed in claim 14 further comprising locating members secured at intervals along each longitudinal side of the centre section, and a mattress longitudinally joined to form three sections corresponding in dimensions to said centre section and outer sections of the mattress frame, said locating members being arranged to abut against the longitudinal sides of the centre mattress section to prevent slip between said mattress and said mattress frame.

* * * * *

UNITED STATES PATENT AND TRADEMARK OFFICE

CERTIFICATE OF CORRECTION

PATENT NO. : 4,084,274

DATED : April 18, 1978

INVENTOR(S) : David John Willis et al

It is certified that error appears in the above-identified patent and that said Letters Patent are hereby corrected as shown below:

Column 6, line 25, "13" should be --1--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*